US011041454B2

(12) United States Patent
Oh

(10) Patent No.: US 11,041,454 B2
(45) Date of Patent: Jun. 22, 2021

(54) METHOD AND SYSTEM FOR CORRECTING FUEL INJECTION AMOUNT

(71) Applicants: Hyundai Motor Company, Seoul (KR); Kia Motors Corporation, Seoul (KR)

(72) Inventor: Jeong Sang Oh, Incheon (KR)

(73) Assignees: Hyundai Motor Company, Seoul (KR); Kia Corporation, Seoul (KR)

( * ) Notice: Subject to any disclaimer, the term of this patent is extended or adjusted under 35 U.S.C. 154(b) by 0 days.

(21) Appl. No.: 16/678,578

(22) Filed: Nov. 8, 2019

(65) Prior Publication Data

US 2020/0400092 A1 Dec. 24, 2020

(30) Foreign Application Priority Data

Jun. 18, 2019 (KR) ..... 10-2019-0071970

(51) Int. Cl.
*F02M 65/00* (2006.01)
*F02D 41/38* (2006.01)
*F02M 63/02* (2006.01)

(52) U.S. Cl.
CPC ..... *F02D 41/3845* (2013.01); *F02M 63/0225* (2013.01); *F02M 65/001* (2013.01); *F02M 65/003* (2013.01); *F02D 2200/0602* (2013.01); *F02D 2250/31* (2013.01)

(58) Field of Classification Search
CPC ..... F02M 65/001; F02M 65/003; F02D 2200/0602
USPC ..... 73/114.43, 114, 48; 701/104
See application file for complete search history.

(56) References Cited

U.S. PATENT DOCUMENTS 6,901,791 B1 * 6/2005 Frenz ..... F02D 41/221 73/114.41
7,299,706 B2 * 11/2007 Palazzolo ..... G01F 1/666 73/114.48
7,516,652 B2 * 4/2009 Schulz ..... F02D 41/3809 73/114.38
9,765,725 B2 * 9/2017 Nieddu ..... F02D 41/402
2006/0156801 A1 * 7/2006 Kuhn ..... F02M 65/005 73/114.48
2009/0205413 A1 * 8/2009 Yamauchi ..... F02M 65/003 73/114.41
2013/0275026 A1 * 10/2013 Methil-Sudhakaran ..... F02D 41/221 701/103
2015/0233318 A1 * 8/2015 Nieddu ..... F02D 41/1401 701/104
2018/0142644 A1 * 5/2018 Cancellieri ..... F02D 41/40

* cited by examiner

FOREIGN PATENT DOCUMENTS

KR 10-0534724 B1 12/2005

*Primary Examiner* — Erick R Solis
(74) *Attorney, Agent, or Firm* — Morgan, Lewis & Bockius LLP

(57) ABSTRACT

A method and system for correcting a fuel injection amount that injects fuel may include applying a current value for injecting a target fuel amount and injecting fuel under a driving condition in which fuel injection is blocked; determining a frequency analysis value for a pressure signal of the fuel pressure rail when the fuel is injected; determining a fuel amount difference corresponding to a difference value between the frequency analysis value and a reference frequency analysis value stored in a data storage in advance; and correcting a current value of the injector which is applied to inject the target fuel amount to remove the fuel amount difference.

13 Claims, 5 Drawing Sheets

METHOD AND SYSTEM FOR CORRECTING FUEL INJECTION AMOUNT

CROSS-REFERENCE TO RELATED APPLICATION

The present application claims priority to Korean Patent Application No. 10-2019-0071970, filed on Jun. 18, 2019 in the Korean Intellectual Property Office, the entire contents of which is incorporated herein for all purposes by this reference.

BACKGROUND OF THE INVENTION

Field of the Invention

The present invention relates to a method and system for correcting a fuel injection amount, the method and system correcting a difference of the fuel amount which is injected through an injector using the characteristics of a pressure signal which is detected from a fuel pressure rail.

Description of Related Art

A fuel supply system that sends fuel from a fuel tank to an engine includes a fuel pump module that sends fuel in a fuel tank to the front end portion of an engine high-pressure pump, a high-pressure pump that increases fuel pressure to high pressure, a fuel pressure rail that maintains the fuel at high pressure before the fuel is injected into cylinders, and an injector that finally injects the fuel.

Meanwhile, in an electronic control fuel injection system, an optimal fuel amount is determined to be suitable for the operation state of an engine and the traveling state of a vehicle by an Electronic Control Unit (ECU) and an appropriate fuel amount is injected through an injector by determining a necessary fuel amount in accordance with operation of an accelerator pedal by a driver.

However, there is a problem of a difference between the actual fuel amount and a target fuel amount which is injected through an injector due to several reasons including the difference in quality of injectors, which results in a problem of inaccurate control the temperature of a catalyst in addition to deterioration of EM.

The information included in this Background of the present invention section is only for enhancement of understanding of the general background of the present invention and may not be taken as an acknowledgement or any form of suggestion that this information forms the prior art already known to a person skilled in the art.

BRIEF SUMMARY

Various aspects of the present invention are directed to providing a method and system for correcting a fuel injection amount, wherein a difference of the fuel amount which is injected through an injector is corrected using the characteristics of a pressure signal which is detected from a fuel pressure rail.

In view of an aspect, a method of correcting a fuel injection amount according to an exemplary embodiment of the present invention may include: applying a current value for injecting a target fuel amount to an injector and injecting fuel when a fuel amount correction driving condition that does not requires fuel injection is satisfied, by a controller; detecting a pressure signal of a fuel rail pressure from which fuel is injected when the fuel is injected, by the controller;

determining a frequency analysis value of the detected pressure signal by the controller; determining a fuel amount difference corresponding to a difference value between the determined frequency analysis value and a reference frequency analysis value stored in advance, by the controller; and correcting a current value of an injector of the fuel pressure rail, the current value of the injector being applied to inject the target fuel amount to remove the fuel amount difference, by the controller.

The current value for injecting the target fuel amount may be applied to one of several injectors of the fuel pressure rail, injecting fuel through the corresponding injector.

The pressure signal may be a signal which is detected by a pressure sensor mounted on the fuel pressure rail.

A frequency analysis value may be determined by analyzing the detected pressure signal through a Fast Fourier Transform (FFT) algorithm.

The current value of the injector which is applied to inject the target fuel amount may be corrected by: determining a maximum frequency analysis value for the target fuel amount through the FFT algorithm analysis; determining a difference value between the determined maximum frequency analysis value and a maximum reference frequency analysis value stored in the data storage for the target fuel amount; determining the fuel amount difference corresponding to the difference value; and determining a current value corresponding to the fuel amount difference.

Current value correction of the injector may be sequentially performed on all injectors of the fuel pressure rail.

Current value correction of the injector may be performed for each corresponding target fuel amount by differently setting target fuel amount to be learned.

When the fuel amount correction driving condition is satisfied, fuel may be injected by applying a current value previously learned through correction.

In view of another aspect, a system for correcting a fuel injection amount according to an exemplary embodiment of the present invention may include: a fuel injection controller that applies a current value for injecting a target fuel amount to an injector such that fuel is injected when a driving condition that does not requires fuel injection is determined; a pressure signal analyzer that detects a pressure signal of the fuel pressure rail and determines a frequency analysis value of the detected pressure signal when fuel according to the target fuel amount is injected; a fuel difference calculator that determines a fuel amount difference corresponding to a difference value between a frequency analysis value for the determined target fuel amount and a reference frequency analysis value stored in a data storage in advance; and a fuel injection corrector that corrects a current value of the injector which is applied to inject the target fuel amount to remove the determined fuel amount difference.

According to an exemplary embodiment of the present invention, the difference between a target fuel amount and the amount of the actually injected fuel is removed and fuel is injected to be more suitable for the driving conditions of the vehicle, whereby the temperature of a catalyst is more accurately controlled. Accordingly, there is an effect in that it is possible to improve EM and prevent hardware damage to the catalyst.

The methods and apparatuses of the present invention have other features and advantages which will be apparent from or are set forth in more detail in the accompanying drawings, which are incorporated herein, and the following Detailed Description, which together serve to explain certain principles of the present invention.

Figure 1:
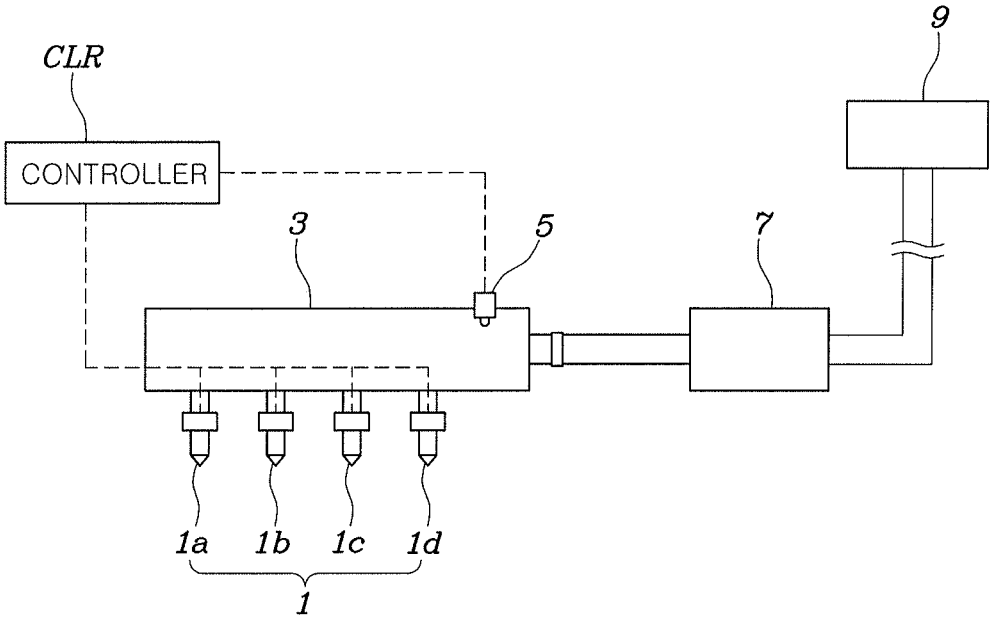
FIG. 1 is a diagram showing the configuration of a system for correcting a fuel injection amount according to an exemplary embodiment of the present invention.

It may be understood that the appended drawings are not necessarily to scale, presenting a somewhat simplified representation of various features illustrative of the basic principles of the present invention. The specific design features of the present invention as included herein, including, for example, specific dimensions, orientations, locations, and shapes will be determined in part by the particularly intended application and use environment.

In the figures, reference numbers refer to the same or equivalent portions of the present invention throughout the several figures of the drawing.

DETAILED DESCRIPTION

Reference will now be made in detail to various embodiments of the present invention(s), examples of which are illustrated in the accompanying drawings and described below. While the present invention(s) will be described in conjunction with exemplary embodiments of the present invention, it will be understood that the present description is not intended to limit the present invention(s) to those exemplary embodiments. On the other hand, the present invention(s) is/are intended to cover not only the exemplary embodiments of the present invention, but also various alternatives, modifications, equivalents and other embodiments, which may be included within the spirit and scope of the present invention as defined by the appended claims.

Exemplary embodiments of the present invention are described hereafter in detail with reference to the accompanying drawings.

FIG. 1 is a diagram showing the configuration of a system for correcting a fuel injection amount according to an exemplary embodiment of the present invention, in which a high-pressure pump 7 that increases the pressure of fuel which is supplied from a fuel tank 9 to high pressure is provided and a fuel pressure rail 3 is provided to store and distribute super high-pressure fuel increased in pressure by the high-pressure pump 7 to individual injectors 1.

Injectors 1*a*, 1*b*, 1*c*, and 1*d* are provided for cylinders, respectively, to receive and supply fuel from the fuel pressure rail 3.

Driving conditions reflecting the traveling state of a vehicle are input to a controller CLR to adjust the fuel amount which is injected through the injectors 1 and a target fuel amount is determined on the basis of the input driving conditions by the controller CLR.

A pressure sensor 5 for measuring pressure in the fuel pressure rail 3 is mounted on the fuel pressure rail 3 and a detecting value of the fuel pressure rail 3 detected by the pressure sensor 5 is transmitted to the controller CLR, whereby pressure may be detected.

The controller CLR may be an ECU. The controller CLR according to exemplary embodiments of the present invention may be implemented through a nonvolatile memory configured to store algorithms for controlling operation of various components of a vehicle or data about software commands for executing the algorithms, and a processor configured to perform operation to be described below using the data stored in the memory. The memory and the processor may be individual chips. Alternatively, the memory and the processor may be integrated in a single chip. The processor may be implemented as one or more processors.

The controller CLR having the present configuration according to an exemplary embodiment of the present invention includes a fuel injection controller 10, a pressure signal analyzer 20, a fuel difference calculator 30, and a fuel information corrector 40.

Figure 2:
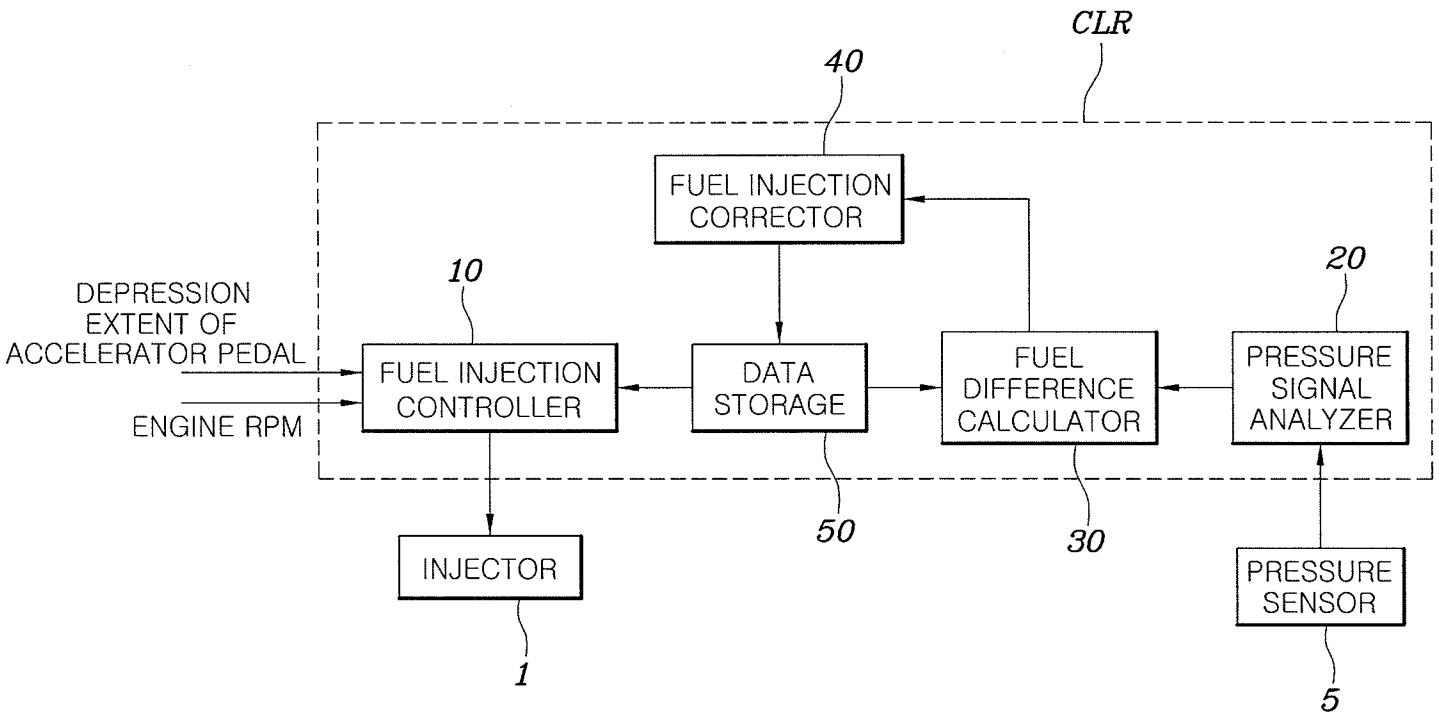
FIG. 2 is a diagram showing an example of the configuration of a controller according to an exemplary embodiment of the present invention.

Referring to FIG. 2, first, the fuel injection controller 10 applies a current value for injecting a target fuel amount to an injector 1 such that fuel is injected when it is determined that a fuel amount correction driving condition that does not requires fuel injection is satisfied.

When the fuel amount correction driving condition is satisfied, the current value which is applied to the injector 1 is a current value previously learned through correction and fuel may be injected in accordance with the applied current value.

The controller CLR may further include a data storage 50 and current values that will be applied to the injector 1 for each of target fuel amounts may be stored in the data storage 50.

The target fuel amount is a fuel amount to be learned and several target fuel amounts may be set within a fuel injection amount which is used for pilot injection and may be stored in the data storage 50. The learning order of the stored target fuel amount may be freely determined or the learning order of target fuel amounts stored in accordance with the traveling states of a vehicle may be determined.

The pressure signal analyzer 20 detects a pressure signal from the fuel pressure rail 3 from which fuel is injected, through the pressure sensor 5 and determines a frequency analysis value of the detected pressure signal when fuel according to a target fuel amount is injected. The frequency analysis value of the pressure signal may be determined using a FFT algorithm.

The fuel difference calculator 30 determines a fuel amount difference corresponding to the difference between the frequency analysis value for the target fuel amount determined by the pressure signal analyzer 20 and a reference frequency analysis value stored in advance.

Reference frequency analysis values for pressure signals detected from the fuel pressure rail 3 when fuel is injected are stored in advance in the data storage 50 respectively for target fuel amounts through tests. Accordingly, it is possible to compare the frequency analysis value determined for the pressure signal and a reference frequency analysis value with each other.

The fuel injection corrector 40 corrects a current value of the injector 1 which is applied to inject the target fuel amount to remove the fuel amount difference determined by the fuel difference calculator 30.

For example, when a correction current value for correction of the injector 1 is determined, the fuel injection corrector 40 corrects and learns a corresponding current value by reflecting the correction current value to the current value of a corresponding target fuel amount stored in the data storage 50. Accordingly, when a target fuel amount is injected through a corresponding injector 1, the operation of the injector 1 is controlled with the current value learned through correction and the fuel is injected.

Accordingly, the difference between the target fuel amount and the amount of the actually injected fuel is removed and fuel is injected to be more suitable for driving conditions of the vehicle, whereby the temperature of a catalyst is more accurately controlled. Accordingly, it is possible to improve EM and prevent hardware damage to the catalyst.

On the other hand, a method of correcting a fuel injection amount according to an exemplary embodiment of the present invention includes a fuel injection control step, a pressure signal detection step, a frequency analysis step, a fuel amount difference determination step, and a fuel injection correction step.

Figure 3:
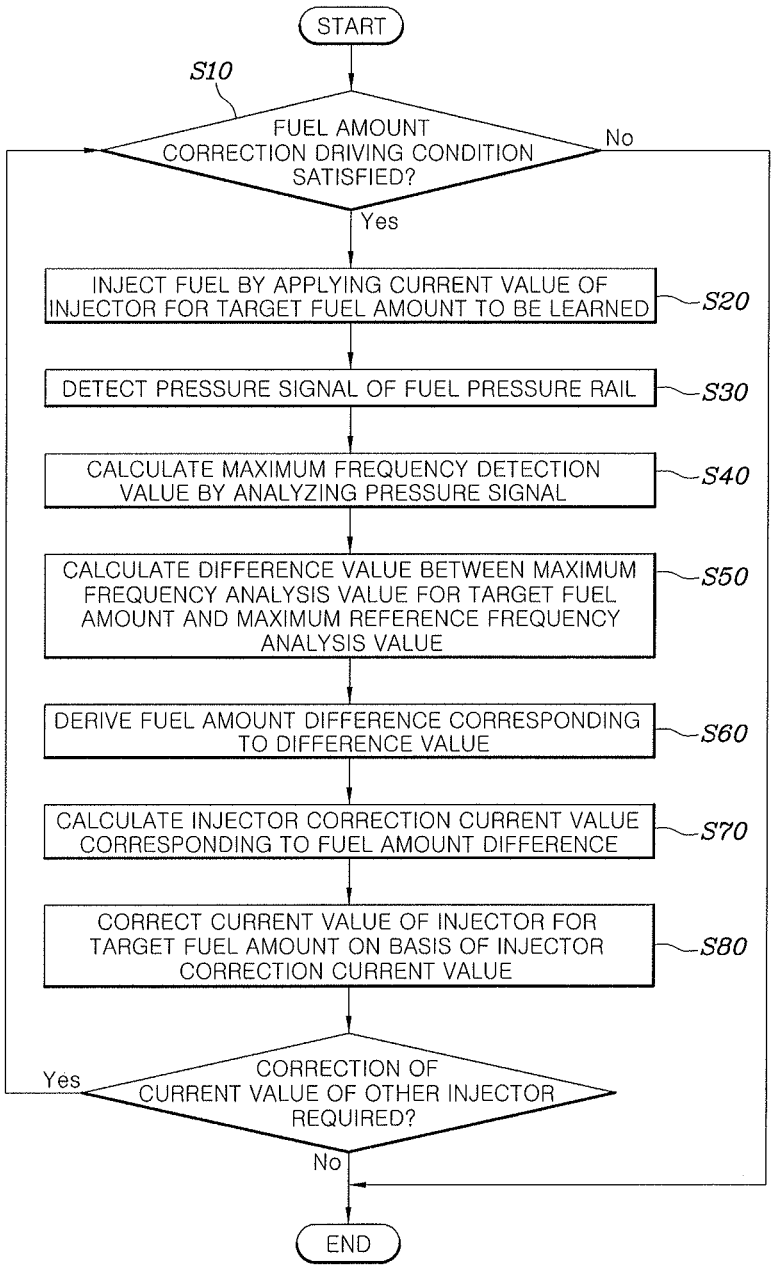
FIG. 3 is a diagram showing an example of a process of correcting a fuel injection amount according to an exemplary embodiment of the present invention.

Referring to FIG. 3, first, in the fuel injection the controller CLR applies a current value for injecting a target fuel amount to an injector 1 to inject fuel under a driving condition that does not requires fuel injection.

That is, a current value for injecting a target fuel amount is applied to one of several injectors 1, whereby fuel is injected through the corresponding injector 1.

The driving condition that does not requires fuel injection may be overrun in which fuel which is supplied to an injector valve when an engine brake is used or deceleration is performed is fully closed, and may be other driving conditions in which fuel injection is blocked.

Figure 4:
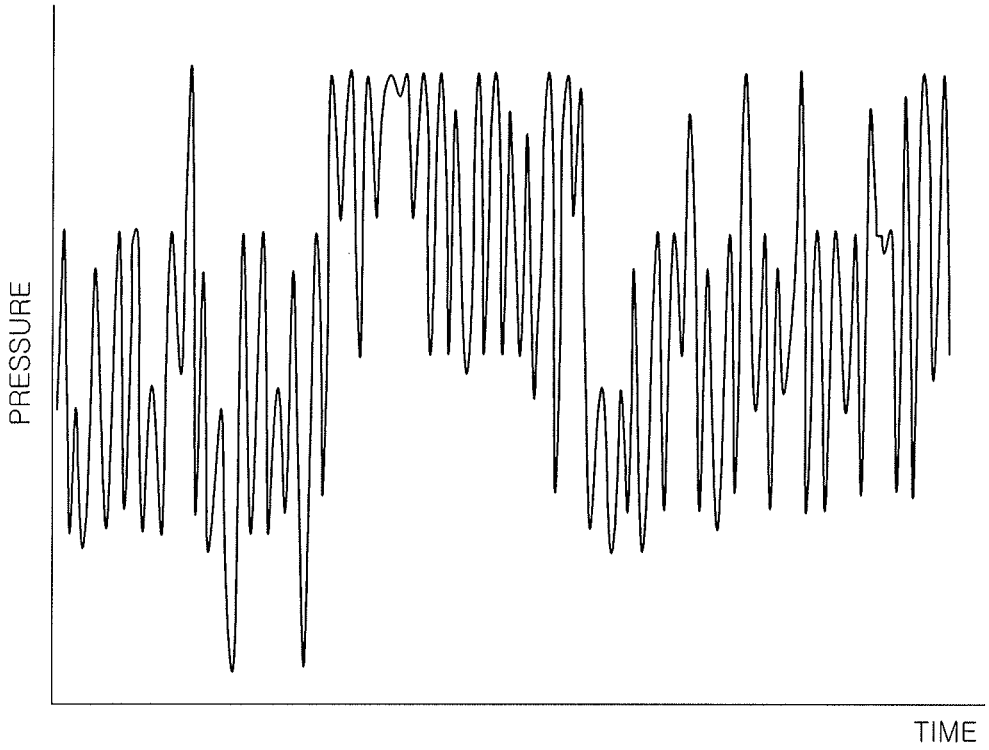
FIG. 4 is a diagram showing an example of pressure which is detected through a fuel sensor of the present invention.

Next, in the pressure signal detection step, the controller CLR detects a pressure signal from the fuel pressure rail 3 from which fuel is injected, as shown in FIG. 4.

The pressure signal may be a signal which is detected by the pressure sensor 5 mounted on the high-pressure fuel pressure rail 3 (e.g., a common rail).

In the frequency analysis step, the controller CLR determines a frequency analysis value of the detected pressure signal.

Figure 5:
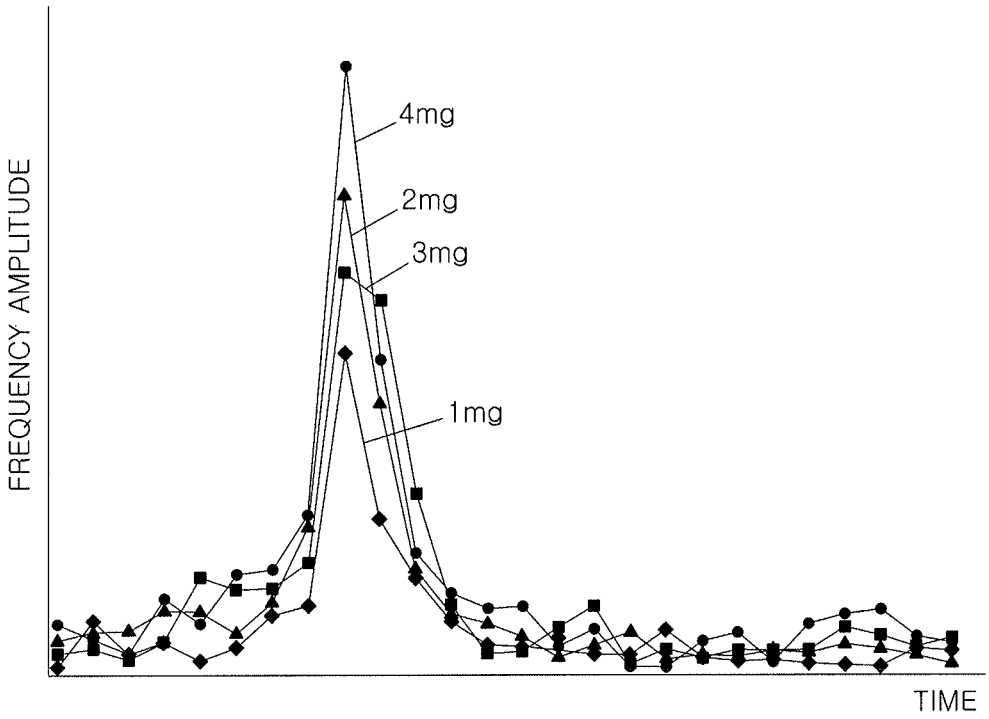
FIG. 5 is a diagram showing an example of a frequency analysis values for each target fuel amount of an input signal which is detected in FIG. 4.

For example, it is possible to determine a frequency analysis value by analyzing the detected pressure signal through a Fast Fourier Transform (FFT) algorithm and FIG. 5 is a graph showing frequency analysis values respectively for target fuel amount.

Next, in the fuel amount difference determination step, the controller CLR determines a fuel amount difference corresponding to the difference value between the determined frequency analysis value and a reference frequency analysis value stored in advance.

In the fuel injection correction step, the controller CLR corrects a current value of an injector 1 which is applied to inject the target fuel amount to remove the fuel amount difference.

For example, a maximum frequency analysis value is determined from a target fuel amount through analysis using the FFT algorithm.

Furthermore, the difference value between the determined maximum frequency analysis value and a maximum reference frequency analysis value stored for the target fuel amount in the data storage 50 is determined.

That is, a maximum frequency analysis value which is the peak value of the determined frequency analysis value and a maximum reference frequency analysis value which is the peak value of a stored frequency analysis value are compared. The reason of comparing maximum values, as described above, is for increasing reliability of corresponding target fuel amount because the peak values of analysis values determined through frequency analysis for target fuel amounts have large differences and the other analyzed values for the target fuel amounts have little differences.

Next, a fuel amount difference corresponding to the difference between the determined maximum frequency analysis value and the stored maximum reference frequency analysis value and a current value corresponding to the fuel amount difference is determined, whereby a current value of the injector 1 which is applied to inject the target fuel amount is corrected.

Such correction of a current value for the injector may be sequentially performed for all the injectors 1. That is, when an engine has four injectors 1*a*, 1*b*, 1*c*, and 1*d*, current value correction may be performed for all of the four injectors 1*a*, 1*b*, 1*c*, and 1*d*.

Furthermore, current value correction of the injectors 1 may be performed for each of target fuel amount by differently setting the target fuel amounts to be learned.

For example, when a current value of any one injector 1 is corrected, the target fuel amount may be set in the unit of 1 mg/str and a current value of the injector 1 may be corrected for each target fuel amount.

The entire flow of the process of correcting a fuel injection amount of the present invention is described with reference to FIG. 3. It is determined whether a driving condition that does not require fuel injection is satisfied is determined in accordance with driving conditions of a vehicle which is being driven (S10).

When the driving condition that does not require fuel injection is satisfied, as the result of determination in S10, a current value of an injector 1 for a target fuel amount of the injector 1 to be learned is applied and fuel is injected (S20). That is, a current value of the injector 1 for injecting a target fuel amount to be learned is applied to the injector 1, whereby fuel is injected by the target fuel amount.

When fuel is injected by the target fuel amount, as described above, a pressure signal is detected through the pressure sensor 5 mounted on the fuel pressure rail 3 (S30) and a maximum frequency analysis value for the target fuel amount is determined by analyzing the detected pressure signal through an FFT algorithm (S40).

Next, the maximum frequency analysis value for the currently injected target fuel amount and a maximum reference frequency analysis value stored for the target fuel amount in the data storage 50 are compared, determining the difference value of the analysis values (S50).

Furthermore, a fuel amount difference corresponding to the difference value is determined (S60), a correction current value of the injector 1 corresponding to the fuel amount difference is determined (S70), correcting a current value of the injector 1 which is applied to inject the target fuel amount (S80).

Next, the present correction process may be performed on the injector 1 for each of target fuel amounts to be learned. Furthermore, the present correction process is performed on injector other than the injector 1 for each of target fuel amounts to be learned, being able to correct the fuel injection amounts of the injectors 1.

As described above, according to an exemplary embodiment of the present invention, the difference between a target fuel amount and the amount of the actually injected fuel is removed and fuel is injected to be more suitable for driving conditions of the vehicle, whereby the temperature of a catalyst is more accurately controlled. Accordingly, it is possible to improve EM and prevent hardware damage to the catalyst.

For convenience in explanation and accurate definition in the appended claims, the terms "upper", "lower", "inner", "outer", "up", "down", "upwards", "downwards", "front", "rear", "back", "inside", "outside", "inwardly", "outwardly", "internal", "external", "inner", "outer", "forwards", and "backwards" are used to describe features of the exemplary embodiments with reference to the positions of such features as displayed in the figures. It will be further understood that the term "connect" or its derivatives refer both to direct and indirect connection.

The foregoing descriptions of specific exemplary embodiments of the present invention have been presented for purposes of illustration and description. They are not intended to be exhaustive or to limit the present invention to the precise forms disclosed, and obviously many modifications and variations are possible in light of the above teachings. The exemplary embodiments were chosen and described to explain certain principles of the present invention and their practical application, to enable others skilled in the art to make and utilize various exemplary embodiments of the present invention, as well as various alternatives and modifications thereof. It is intended that the scope of the present invention be defined by the Claims appended hereto and their equivalents.

What is claimed is:

1. A method of correcting a fuel injection amount, the method comprising:

applying a current value for injecting a target fuel amount to an injector of a fuel pressure rail and injecting fuel, upon determining, by a controller, that a fuel amount correction driving condition that does not requires fuel injection is satisfied;

detecting a pressure signal of a fuel rail pressure from which the fuel is injected, upon determining, by the controller, that the fuel is injected;

determining, by the controller, a frequency analysis value of the detected pressure signal;

determining, by the controller, a fuel amount difference corresponding to a difference value between the determined frequency analysis value and a reference frequency analysis value stored in a data storage in advance; and correcting, by the controller, the current value of the injector, the current value of the injector being applied to inject the target fuel amount to remove the fuel amount difference, wherein the frequency analysis value is determined by analyzing the detected pressure signal through a Fast Fourier Transform (FFT) algorithm, and wherein the current value of the injector which is applied to inject the target fuel amount is corrected by:

determining a maximum frequency analysis value for the target fuel amount through an analysis of the FFT algorithm;

determining a difference value between the determined maximum frequency analysis value and a maximum reference frequency analysis value stored in the data storage for the target fuel amount;

determining the fuel amount difference corresponding to the difference value; and determining the current value corresponding to the fuel amount difference.

2. The method of claim 1, wherein the current value for injecting the target fuel amount is applied to one of predetermined injectors of the fuel pressure rail, injecting fuel through a corresponding injector.

3. The method of claim 1, wherein the pressure signal is a signal which is detected by a pressure sensor mounted on the fuel pressure rail.

4. The method of claim 1, wherein current value correction of the injector is sequentially performed on all injectors of the fuel pressure rail.

5. The method of claim 1, wherein current value correction of the injector is performed for each corresponding target fuel amount by differently setting target fuel amount to be learned.

6. The method of claim 1, wherein when the fuel amount correction driving condition is satisfied, the fuel is injected by applying a current value previously learned through correction.

7. A system of correcting a fuel injection amount, the system comprising:

a fuel injection controller that applies a current value for injecting a target fuel amount to an injector of a fuel pressure rail such that fuel is injected when a driving condition that does not require fuel injection is determined;

a pressure signal analyzer that detects a pressure signal of the fuel pressure rail and determines a frequency analysis value of the detected pressure signal upon determining that fuel according to the target fuel amount is injected;

a fuel difference calculator that determines a fuel amount difference corresponding to a difference value between a frequency analysis value for the determined target fuel amount and a reference frequency analysis value stored in a data storage in advance; and a fuel injection corrector that corrects the current value of the injector which is applied to inject the target fuel amount to remove the determined fuel amount difference, wherein the frequency analysis value is determined by analyzing the detected pressure signal through a Fast Fourier Transform (FFT) algorithm, and wherein the current value of the injector which is applied to inject the target fuel amount is corrected by:

determining a maximum frequency analysis value for the target fuel amount through an analysis of the FFT algorithm;

determining a difference value between the determined maximum frequency analysis value and a maximum reference frequency analysis value stored in the data storage for the target fuel amount;

determining the fuel amount difference corresponding to the difference value; and determining the current value corresponding to the fuel amount difference.

8. A system of correcting a fuel injection amount, the system comprising a controller configured of:

applying a current value for injecting a target fuel amount to an injector of a fuel pressure rail such that fuel is injected when a driving condition that does not require fuel injection is determined;

detecting a pressure signal of the fuel pressure rail and determining a frequency analysis value of the detected pressure signal upon determining that the fuel according to the target fuel amount is injected;

determining a fuel amount difference corresponding to a difference value between a frequency analysis value for the determined target fuel amount and a reference frequency analysis value stored in a data storage in advance; and correcting the current value of the injector which is applied to inject the target fuel amount to remove the determined fuel amount difference, wherein the frequency analysis value is determined by analyzing the detected pressure signal through a Fast Fourier Transform (FFT) algorithm, and wherein the current value of the injector which is applied to inject the target fuel amount is corrected by:

determining a maximum frequency analysis value for the target fuel amount through an analysis of the FFT algorithm;

determining a difference value between the determined maximum frequency analysis value and a maximum reference frequency analysis value stored in the data storage for the target fuel amount;

determining the fuel amount difference corresponding to the difference value; and determining the current value corresponding to the fuel amount difference.

9. The system of claim 7, wherein the current value for injecting the target fuel amount is applied to one of predetermined injectors of the fuel pressure rail, injecting fuel through a corresponding injector.

10. The system of claim 7, wherein the pressure signal is a signal which is detected by a pressure sensor mounted on the fuel pressure rail.

11. The system of claim 8, wherein current value correction of the injector is sequentially performed on all injectors of the fuel pressure rail.

12. The system of claim 8, wherein current value correction of the injector is performed for each corresponding target fuel amount by differently setting target fuel amount to be learned.

13. The system of claim 8, wherein when the fuel amount correction driving condition is satisfied, the fuel is injected by applying a current value previously learned through correction.

* * * * *